United States Patent [19]

Law et al.

[11] 4,225,447

[45] Sep. 30, 1980

[54] EMULSIFIABLE LUBRICANT COMPOSITIONS

[75] Inventors: Derek A. Law; Robert H. Davis, both of Pitman; Harry J. Andress, Wenonah, all of N.J.

[73] Assignee: Mobil Oil Corporation, New York, N.Y.

[21] Appl. No.: 1,553

[22] Filed: Jan. 8, 1979

[51] Int. Cl.[2] ..... C10M 1/36; C10M 1/24; C10M 3/30; C10M 3/18

[52] U.S. Cl. ..... 252/34.7; 252/41; 252/42.1; 252/49.5; 252/51.5 A; 252/56 D; 252/76

[58] Field of Search ..... 252/49.5, 34, 34.7, 252/76, 41, 42.1, 51.5 A, 56 D

[56] References Cited

U.S. PATENT DOCUMENTS

| | | | |
|---|---|---|---|
| 3,269,946 | 8/1966 | Wiese | 252/49.5 |
| 3,296,129 | 1/1967 | Sheidker et al. | 252/49.5 |
| 3,378,494 | 4/1968 | Berger | 252/49.5 |
| 3,629,119 | 12/1971 | Weaver | 252/49.5 |
| 3,981,813 | 9/1976 | Den Herder et al. | 252/76 |

*Primary Examiner*—Delbert E. Gantz
*Assistant Examiner*—Irving Vaughn
*Attorney, Agent, or Firm*—Charles A. Huggett; Claude E. Setliff

[57] ABSTRACT

An emulsifiable concentrate for use in water-in-oil fire-resistant hydraulic fluids, comprises lubricant and a polyalkenylsuccinic acid or anhydride or a salt thereof.

9 Claims, No Drawings

EMULSIFIABLE LUBRICANT COMPOSITIONS

BACKGROUND OF THE INVENTION

1. Field of the Invention

This invention relates to emulsifiable lubricants, and particularly those for use in water-in-oil emulsions, containing an alkenylsuccinic anhydride or a salt thereof.

2. Description of the Prior Art

The use of water-in-oil emulsion fluids as lubricants in industrial applications, for example, as hydraulic fluids, and in other areas where lubricants are necessitated, is known to those skilled in the art. An essential component of water-in-oil emulsion lubricants, particularly where these lubricants are employed as hydraulic fluids, is the presence of oil as the continuous phase with water dispersed therein, water comprising from about 10 to less than about 60 percent, by weight, of the total emulsion fluid. It is known to use alkaline earth salts of organic acids and/or sulfonates as water-in-oil emulsifiers.

SUMMARY OF THE INVENTION

In accordance with the invention there is provided an emulsifiable lubricant composition comprising lubricant and (1) an alkenylsuccinic anhydride, wherein the alkenyl is preferably derived from an olefin containing 2 to 10 carbon atoms and has a number average molecular weight of from about 300 to about 3000, preferably such that the molecular weight of the alkenylsuccinic acid anhydride is from about 900 to about 1300, (2) a salt of such anhydride or (3) (1) or (2) in combination with an alkali metal salt of a rosin acid.

DISCUSSION OF SPECIFIC EMBODIMENTS

The emulsifiable lubricant will contain from about 0.5 percent by weight to about 10 percent by weight of the emulsifier, preferably from about 2 percent to about 5 percent by weight, the remainder being lubricant or lubricant and other additives. The lubricant itself will broadly comprise from about 40 percent by weight to about 80 percent by weight of the emulsifiable composition, preferably from about 50 percent to about 70 percent. The remainder of the emulsion will comprise water and, possibly, other additives. Thus, water will range from about 10 to less than about 60 percent by weight.

We have found that an effective olefin for use in the reaction to form alkenylsuccinic anhydride is derived from a mixture of $C_{16}$–$C_{28}$ olefins. This olefin mixture is the bottoms from an olefin oligomerization and the mixture will have the following composition:

TABLE 1

| Ingredient | % by wt. | Other |
|---|---|---|
| Olefin (chain length) | | |
| $C_{16}$ | 2 max. | |
| $C_{18}$ | 5–15 | |
| $C_{20}$ | 42–50 | |
| $C_{22}$ | 20–28 | |
| $C_{24}$ | 6–12 | |
| $C_{26}$ | 1–3 | |
| $C_{28}$ | 2 max. | |
| Alcohol | 10 max. | |
| Paraffin | 5 max. | |
| Iodine NO. | | 74 min. |
| Peroxide | | 10 ppm max. |
| Olefin types by NMR | | |
| Vinyl | 28–44 | |
| Branched | 30–50 | |

TABLE 1-continued

| Ingredient | % by wt. | Other |
|---|---|---|
| Internal | 26–42 | |

Because of the source of the olefin mixture, one does not always get the same product from successive batches, but each mixture used will have a composition falling within the ranges stated and will be equally effective for use in this invention. The olefin mixture is reacted with maleic anhydride or acid to give the polyolefin-substituted succinic compound at from about 150° C. to about 250° C. Other olefins may be used, as set forth hereinabove.

As will become apparent from the following, "salts" refers to full salts of the anhydride or, when the reactant is an amine, a salt/amide or a salt/ester mixture, depending upon whether the straight amine or the hydroxy amine is used. The reactions below illustrate the types of compounds involved.

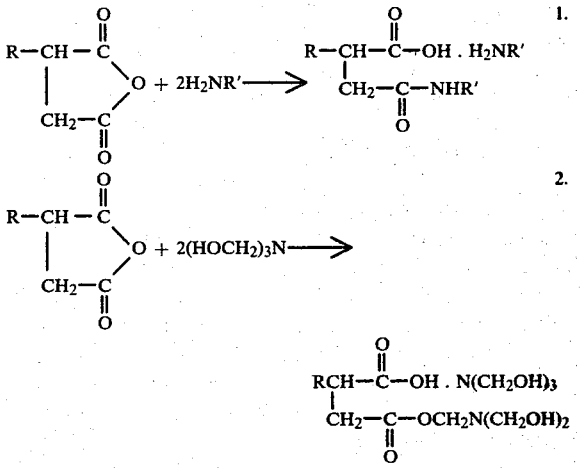

Reactions 1 and 2 will occur in the absence of water during the reaction. When water is present, the anhydride bond will be broken and available for salt formation with one or both of the acid groups, depending upon the quantity of amine reacted.

The above-noted reactions, as well as those that follow, are merely illustrative of the type of compound obtained. The reaction mixtures are extremely complex, and the exact composition of the mixture are unknown.

Preparation of the salts of this invention is shown in accordance with the following scheme:

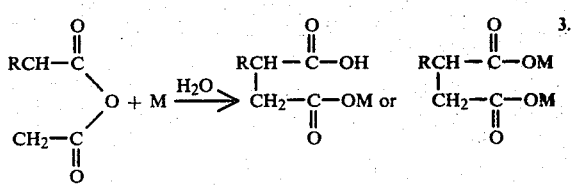

where M is an alkali metal or alkaline earth metal. The amine is water soluble or dispersable and may be a primary or secondary alkylamine having 1 to 10 carbon atoms, or it may be a soluble tertiary alkylamine, e.g. trimethylamine. Also included are any of these amines containing from 1 to 3 hydroxyl groups. Thus, methyl- and dimethylamine, ethyl- and diethylamine, propyl- and dipropylamine and the like are contemplated, as well as ethanol-, diethanol- and triethanolamine.

The metals contemplated are the alkali metals of Group I and the alkaline earth metals of Group II of the Periodic Table. These will preferably be in the form of the hydroxide, but can also be used as the chloride, sulfate, nitrate, acetate and the like.

As is evident from the above discussion, the salts may be formed by adding 1 or 2 equivalents of the metal compound or the amine per equivalent of the alkenylsuccinic anhydride directly to a lubricating oil containing such anhydride. The salt is preferably formed by adding the metal compound or amine to a water phase emulsion containing the anhydride. The salt may also be prepared separately and added to the lubricant. In any event, the temperature of reaction will range from about ambient to about 175° F.

When two equivalents of metal compound or amine are used for disubstitution, an excess of such reactant may be used, preferably from about 10% to about 15% by weight.

The oil vehicles employed in the composition of the present invention may comprise mineral oils, synthetic oils, especially synthetic hydrocarbon oils, or combinations of mineral oils with synthetic oils of lubricating viscosity. When high temperature stability is not a requirement, mineral oils having a viscosity of at least 40 SSU at 100° F., and particularly those falling within the range from about 60 SSU to about 6,000 SSU at 100° F. may be employed. In instances where synthetic vehicles are employed, either alone or in addition to mineral oils, as the lubricating vehicle, various compounds of this type may be successfully utilized. Typical synthetic vehicles include polypropylene glycol, trimethylolpropane esters, neopentyl and pentaerythritol esters, di-(2-ethyl hexyl)sebacate, di-(2-ethyl hexyl)adipate, dibutyl phthalate, fluorocarbons, silicate esters, silanes, esters of phosphorus-containing acids, liquids ureas, ferrocene derivatives, hydrogenated mineral oils, chain-type polyphenols, siloxanes and silicones (poly-siloxanes), alkyl-substituted diphenyl ethers typified by a butyl-substituted bis-(p-phenoxy phenyl)ether, phenoxy phenyl ethers, and the like.

The synthetic hydrocarbons which may be used are of the type normally made by polymerizing monoolefins in the presence of a suitable catalyst, such as $BF_3$ or $AlCl_3$. The lower olefins may be employed for this purpose provided the degree of polymerization is sufficient. The lower olefins include, for example, ethylene, propylene, butylene and the like. Those useful in the practice of this invention preferably contain at least 30 carbon atoms. One such member is made by trimerizing decene. The synthetic hydrocarbon, or polyolefin, suitable for use in this invention may have an upper limit of about 75 carbon atoms. Such hydrocarbon fluids retain their fluidity at the lower temperatures and have enhanced resistance to flame and explosion hazards.

EXAMPLES

Products of Examples 1–8 of Tables 2 and 3 were made by (1) mixing oil and PBSA, (2) mixing water and amine or metal compound and (3) combining the two phase and homogenizing in a Waring blender. The additional additives shown in Table 3 are added before homogenizing.

EVALUATION OF THE PRODUCTS

Water-in-Oil Emulsion Stability Test a. Oven Storage Test (Test No. 1)

One hundred grams of emulsion are added to a 4-ounce tall form bottle and placed in an oven at 190° F. At intervals, the percent oil separation and percent water separation were measured.

b. Freeze-Thaw Test (Test No. 2)

One hundred grams of emulsion were added to a 4-ounce tall form bottle and placed in a freezer to 0° F. for 16 hours. It was then removed to room temperature and kept there for eight hours. The procedure was repeated for ten cycles. Oil and/or water separation was normally less than five percent.

Multimetal Vapor Phase Rust Test (Test No. 3)

One hundred grams of emulsion were placed in an 8-ounce jar and sealed with a lid, the inside of which had attached to it three metal washers: aluminum; copper; and steel. The jar was then placed in an upright position in a water bath heated to 150° F. The washers were checked and rated for degree of corrosion after one-and-one-half hours and eighteen hours of testing.

The data obtained in the above tests are summarized in Tables 2 and 3.

TABLE 2

| Example | 1 | 2 | 3 | 4 | 5 |
|---|---|---|---|---|---|
| PBSA[1], % wt. | 0 | 3.0 | 3.0 | 3.0 | 3.0 |
| TEA[2], % wt. | 0 | 0 | 0.6 | 0.2 | 0 |
| Rosin Soap[3], % wt. | 0 | 0 | 0 | 0 | 1.0 |
| Oil[4], % wt. | 57.0 | 54.0 | 53.4 | 53.8 | 53.0 |
| $H_2O$, % wt. | 43.0 | 43.0 | 43.0 | 43.0 | 43.0 |
| Test No. 1 (5 days at 190° F.) | | | | | |
| Oil Sepn. % | 60.0 | 45.0 | 5.0 | 5.0 | 5.0 |
| $H_2O$ Sepn. % | 40.0 | 2.5 | 0 | 2.5 | 2.5 |

[1]Polybutenylsuccinic anhydride-1300 mol. wt.
[2]Triethanolamine.
[3]Potassium salt of rosin acid.
[4]100 SUS solvent paraffinic neutral mineral oil.

These data indicate that PBSA alone, or the TEA salt or in the presence of the rosin soap functions as an effective emulsifier for water in oil emulsions.

TABLE 3

| Example | 6 | 7 | 8 |
|---|---|---|---|
| PBSA[1] | 3.0 | 3.0 | 3.0 |
| TEA[2] | 0 | 0.2 | 0 |
| NaOH | 0 | 0 | 0.3 |
| IPAE[3] | 0.3 | 0.3 | 0.3 |
| ZnDTP[4] | 0.5 | 0.5 | 0.5 |
| Oil[5] | 53.2 | 53.0 | 52.9 |
| $H_2O$ | 43.0 | 43.0 | 43.0 |
| Test No. 1 (20 days at 200° F.) | | | |
| Oil Sepn. % | 6 | 6 | 3 |
| $H_2O$ Sepn. % | 3 | 2 | 8 |
| Test No. 2 (0° F. to Room Temp., 10 cycles) | | | |
| (<5% oil and $H_2O$ Sepn.) | BP[6] | BP[6] | BP[6] |
| Test No. 3 | | | |
| Compatibility with: | | | |
| Copper | Good | Good | Mod. |
| Steel | Mod. | Poor | Good |
| Aluminum | Mod. | Mod. | Poor |

[1]Polybutenylsuccinic anhydride - 1300 mol. wt.
[2]Triethanolamine.
[3]Isopropylaminoethanol.
[4]Zinc dithiophosphate (Lubrizol 677A).
[5]100 SUS solvent paraffinic neutral mineral oil.
[6]Borderline pass.

These data indicate that the PBSA-containing additive will function effectively as an emulsifier even in the presence of typical additives such as the zinc dithiophosphate.

We claim:

1. An emulsifiable lubricant composition consisting essentially of a lubricating oil and a member selected from the group consisting of (1) an alkenylsuccinic anhydride, wherein said alkenylsuccinic anhydride has a number average molecular weight of from about 300 to about 3000, (2) the alkenylsuccinic anhydride of (1) in combination with a rosin salt and (3) the alkenylsuccinic anhydride of (1) in combination with an amine and a rosin soap.

2. The composition of claim 1 wherein the alkenyl is derived from an olefin having 2 to 10 carbon atoms.

3. The composition of claim 1 containing from about 0.5 to about 10 percent by weight of (1), (2) or (3).

4. The composition of claim 3 containing from about 2 to about 5 percent by weight of (1), (2) or (3).

5. The composition of claim 1 emulsified with from about 10 to less than about 60 percent of water.

6. The composition of claim 5 having in the emulsion from about 40 to about 80 percent by weight of lubricant.

7. The composition of claim 6 having in the emulsion from about 50 to about 70 percent by weight of lubricant.

8. The composition of claim 1 wherein (1) is polyisobutenylsuccinic anhydride having a molecular weight of 1300.

9. The composition of claim 1 wherein the rosin soap is the potassium salt of rosin acid.

* * * * *